US011751293B2

(12) United States Patent
Min

(10) Patent No.: US 11,751,293 B2
(45) Date of Patent: Sep. 5, 2023

(54) TURNTABLE SYSTEM FOR HYBRID COOKING APPLIANCE WITH MICROWAVE AND INDUCTION HEATING FEATURES

(71) Applicant: Haier US Appliance Solutions, Inc., Wilmington, DE (US)

(72) Inventor: YounKi Min, Youngin (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 182 days.

(21) Appl. No.: 17/197,409

(22) Filed: Mar. 10, 2021

(65) Prior Publication Data

US 2022/0295606 A1 Sep. 15, 2022

(51) Int. Cl.
*H05B 6/64* (2006.01)

(52) U.S. Cl.
CPC ..... *H05B 6/6411* (2013.01); *H05B 6/6488* (2013.01)

(58) Field of Classification Search
CPC ..... H05B 6/64; H05B 6/6402; H05B 6/6408; H05B 6/6411; H05B 6/6414; H05B 6/642; H05B 6/647; H05B 6/6464; H05B 6/6473; H05B 6/6479; H05B 6/6482; H05B 6/6485; H05B 6/6488
USPC ..... 219/752–754
See application file for complete search history.

(56) References Cited

U.S. PATENT DOCUMENTS

| | | | | |
|---|---|---|---|---|
| 4,254,319 | A | 3/1981 | Beh | |
| 4,308,445 | A * | 12/1981 | Offutt | H05B 6/6411 219/755 |
| 4,918,275 | A * | 4/1990 | Okamoto | H05B 6/6411 219/754 |
| 5,177,333 | A | 1/1993 | Ogasawara | |
| 5,698,125 | A | 12/1997 | Kwon | |
| 7,351,943 | B1 * | 4/2008 | Kubler | H05B 6/6411 219/754 |
| 8,253,084 | B2 | 8/2012 | Iwamoto | |

FOREIGN PATENT DOCUMENTS

| | | | |
|---|---|---|---|
| EP | 0358561 | A1 | 3/1990 |
| KR | 0136055 | Y1 * | 3/1999 |

* cited by examiner

*Primary Examiner* — Hung D Nguyen
(74) *Attorney, Agent, or Firm* — Dority & Manning, P.A.

(57) ABSTRACT

A cooking appliance includes a cabinet that defines a cooking chamber. A magnetron is mounted within the cabinet and is in communication with the cooking chamber to direct a microwave thereto. An induction heating coil is mounted within the cabinet and is in communication with the cooking chamber to direct a magnetic field thereto. A turntable rotatably mounted in the cooking chamber at a center of the turntable. A motor is operatively coupled to the turntable and is mounted within the cabinet outside of the cooking chamber and adjacent to the induction heating coil. The motor is offset from the center of the turntable, as a result of the offset the motor is positioned outside of the magnetic field from the induction heating coil.

12 Claims, 8 Drawing Sheets

TURNTABLE SYSTEM FOR HYBRID COOKING APPLIANCE WITH MICROWAVE AND INDUCTION HEATING FEATURES

FIELD OF THE INVENTION

The present subject matter relates generally to cooking appliances, and more particularly to cooking appliances having features for microwave and induction heating in a common cavity.

BACKGROUND OF THE INVENTION

Over the past several decades, microwave cooking appliances (i.e., microwave appliances) have become a staple appliance for many, if not most kitchens. Generally, microwave appliances include a cabinet that defines a cooking chamber for receipt of food items for cooking. In order to provide selective access to the cooking chamber and to contain food items and cooking energy (e.g., microwaves) during a cooking operation, a door is further included that is typically pivotally mounted to the cabinet. During use, a magnetron can generate the microwave radiation or microwaves that are directed specifically to the cooking chamber. The microwave radiation is typically able to heat and cook food items within the cooking chamber faster than would be possible with conventional cooking methods using direct or indirect heating methods. Moreover, since microwave appliances are often smaller than other appliances (e.g., a conventional baking oven) within a kitchen, microwave appliances are often preferable for heating relatively small portions or amounts of food.

In spite of the advantages provided by typical microwave appliances, there can be instances where other cooking methods are preferable (e.g., separate from or in addition to microwave cooking in order to heat a specific food slowly or evenly item). Induction cooking, for example, is especially popular since it offers certain safety benefits. Generally, for induction cooking, an induction coil produces a high frequency magnetic field, which can cause eddy currents to flow through a cooking vessel made of steel or stainless steel, and thereby heats the foods by the Joule heat produced in the cooking vessel.

Previous attempts have been made to incorporate an induction coil within the same structure as a magnetron or microwave appliance. Nonetheless, such attempts have largely been unable to adequately shield the induction coil from microwave radiation or microwaves while still permitting a magnetic field at a suitable strength from the induction coil. Additionally, such attempts have encountered difficulty with accommodating both the induction coil and a turntable motor within the same structure.

As a result, it would be advantageous to provide a cooking appliance with features for both induction and microwave cooking.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance includes a cabinet that defines a cooking chamber. The cooking appliance also includes a magnetron mounted within the cabinet in communication with the cooking chamber to direct a microwave thereto. The cooking appliance further includes an induction heating coil mounted within the cabinet in communication with the cooking chamber to direct a magnetic field thereto. The cooking appliance also includes a turntable rotatably mounted in the cooking chamber and a motor operatively coupled to the turntable. The motor is mounted within the cabinet outside of the cooking chamber and adjacent to the induction heating coil. The motor is offset from a geometric center of the cooking chamber such that the motor is positioned outside of the magnetic field from the induction heating coil.

In another exemplary aspect of the present disclosure, a cooking appliance is provided. The cooking appliance includes a cabinet that defines a cooking chamber. A magnetron is mounted within the cabinet and is in communication with the cooking chamber to direct a microwave thereto. An induction heating coil is mounted within the cabinet and is in communication with the cooking chamber to direct a magnetic field thereto. A turntable rotatably mounted in the cooking chamber at a center of the turntable. A motor is operatively coupled to the turntable and is mounted within the cabinet outside of the cooking chamber and adjacent to the induction heating coil. The motor is offset from the center of the turntable, as a result of the offset the motor is positioned outside of the magnetic field from the induction heating coil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
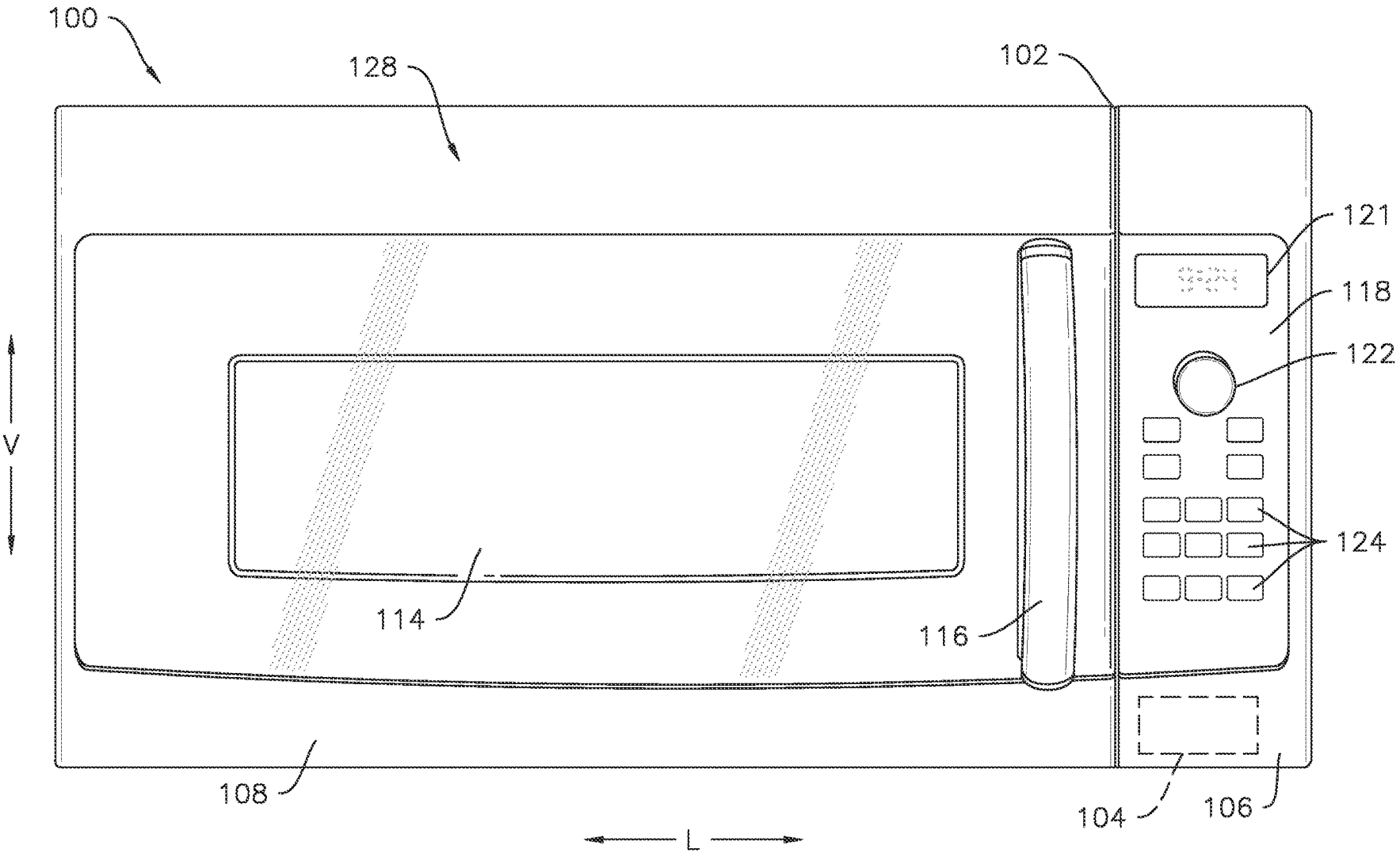
FIG. 1 provides a front view of a cooking appliance according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Furthermore, as used herein, terms of approximation, such as "approximately," "substantially," or "about," refer to being within a ten percent margin of error.

Turning now to the figures, FIG. 1 provides a front view of a cooking appliance 100 according to an example embodiment of the present subject matter. Cooking appliance 100 may, in some example embodiments, be an "over-the-range" oven. In other example embodiments, the cooking appliance 100 may be a countertop oven, a wall oven, or may be provided in various other oven configurations as will be recognized by those of skill in the art.

Cooking appliance 100 includes a housing or casing 102 that defines a cooking cavity 128. Food items can be received within cooking cavity 128. A door 108 is rotatably mounted to casing 102 and is movable between an open position and a closed position (shown in FIG. 1) to provide selective access to cooking cavity 128. A window 114 in door 108 is provided for viewing food items in the cooking cavity 128, and a handle 116 is secured to door 108. Handle 116 can be formed of plastic, for example, and can be injection molded.

As may be seen, e.g., in FIGS. 1 and 3 through 5, the cooking appliance 100 may define a vertical direction V, a lateral direction L, and a transverse direction T. The vertical direction V, the lateral direction L, and the transverse direction T may be mutually perpendicular. In particular, the cooking appliance 100 may extend between a top and a bottom along the vertical direction, between a left side and a right side along the lateral direction L, and between a front and a back along the transverse direction T. For example, "front," "back," "left," and "right" may be defined from the perspective of a user standing in front of the cooking appliance 100 to access the cooking cavity 128 therein, e.g., via the door 108.

Cooking appliance 100 also includes a control panel frame 106. A control panel 118 is mounted within control panel frame 106. Control panel 118 includes a display device 121 for presenting various information to a user. Control panel 118 also includes one or more input devices. For this embodiment, the input devices of control panel 118 include a knob or dial 122 and tactile control buttons 124. Selections are made by rotating dial 122 clockwise or counter-clockwise, and when the desired selection is displayed, pressing dial 122. For example, a user can select a preprogrammed cycle or operation or one or more parameters, such as cook time and heating power, etc., by rotating dial 122 until the desired option is displayed and then pressing dial 122. Instructions and selections may be displayed on display device 121. Furthermore, in some embodiments, display device 121 can also be used as an input device. For instance, in such embodiments, display device 121 can be a touch-screen device. In some embodiments, display device 121 is the only input device of control panel 118.

Figure 3:
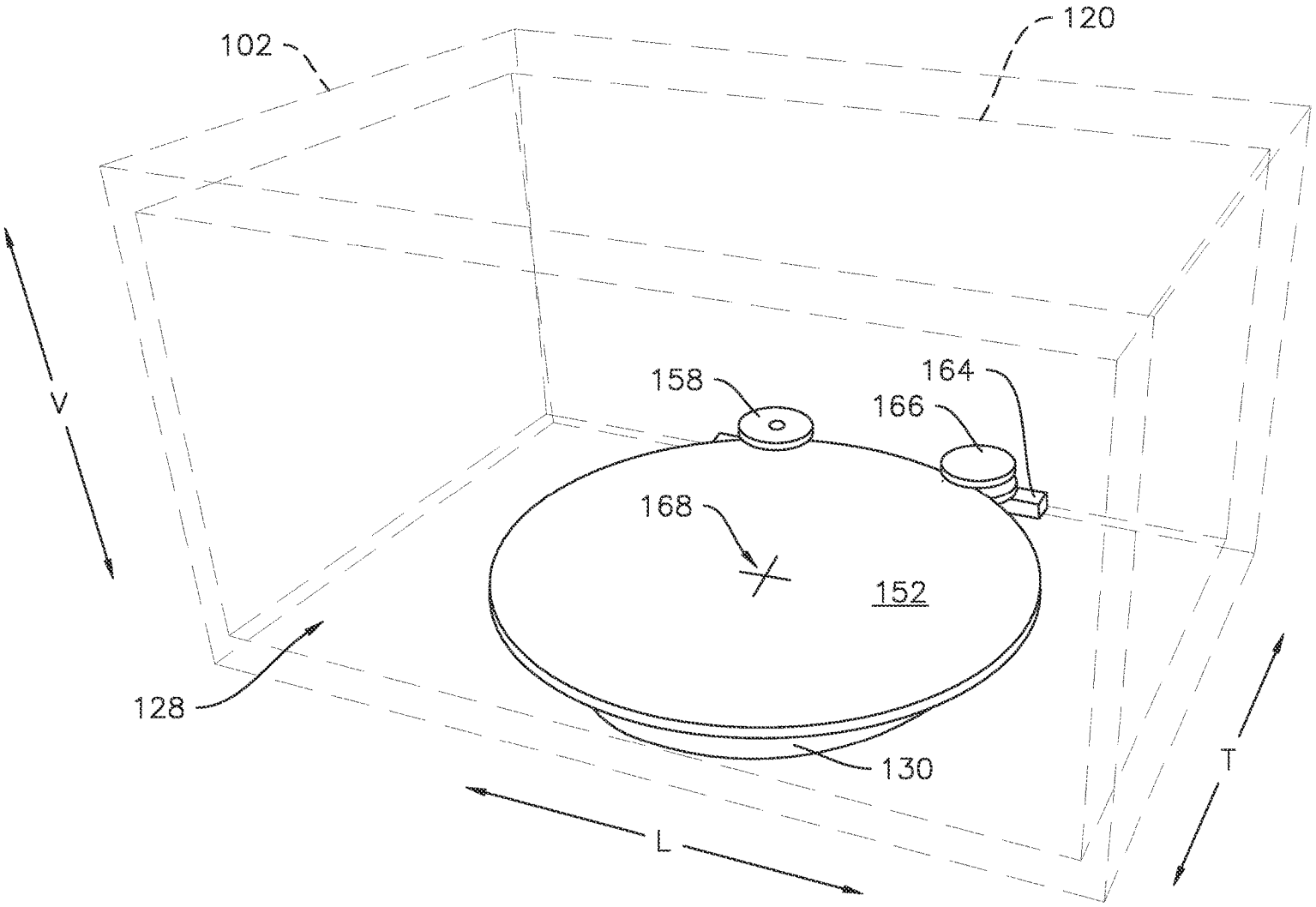
FIG. 3 provides a schematic perspective view of the cooking appliance of FIG. 1 with a cabinet and inner shell thereof hidden in order to illustrate internal components thereof more clearly.
Figure 4:
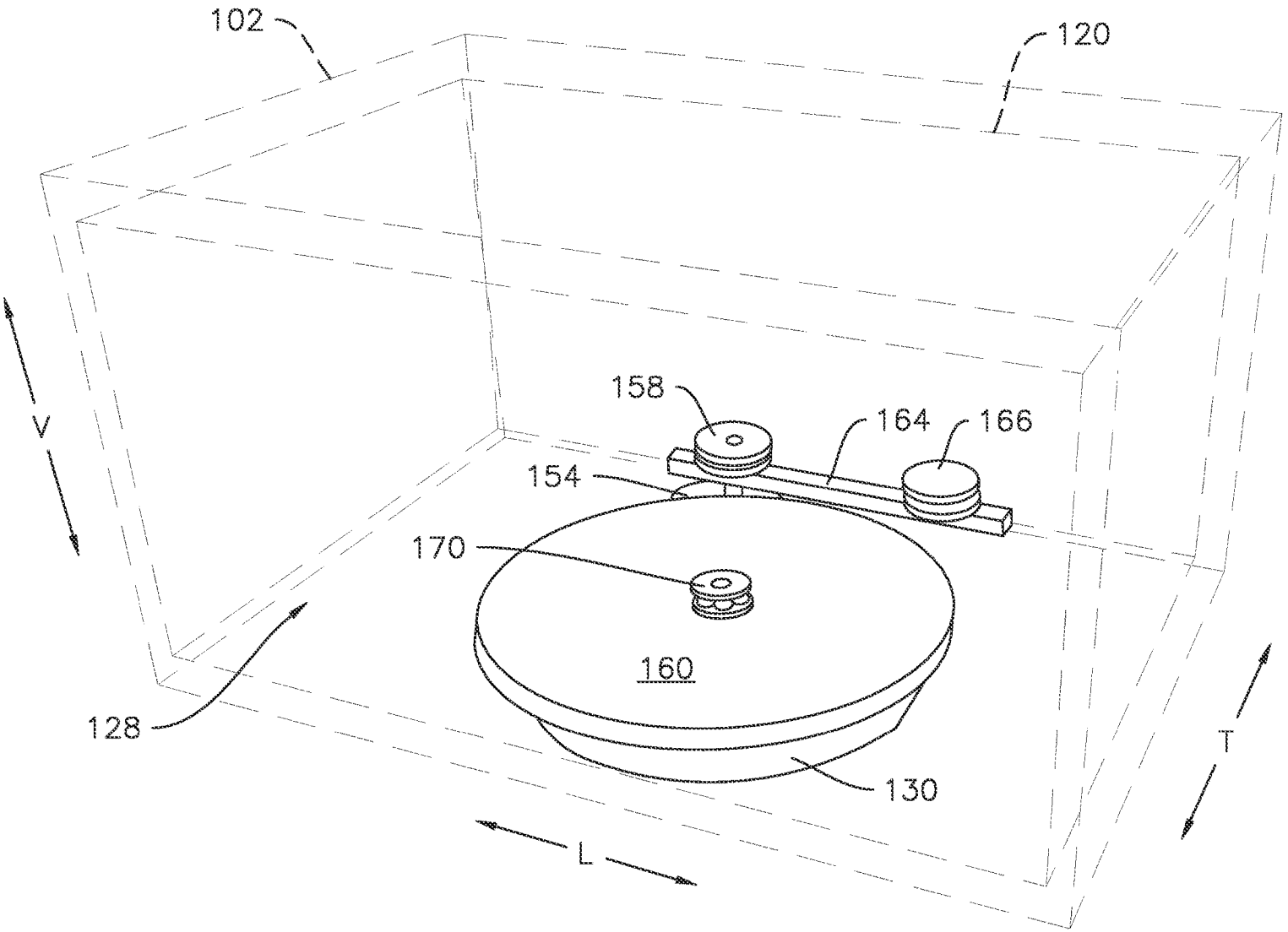
FIG. 4 provides a similar view as FIG. 3 with a turntable of the cooking appliance removed to more clearly illustrate components of the cooking appliance positioned below the turntable.
Figure 5:
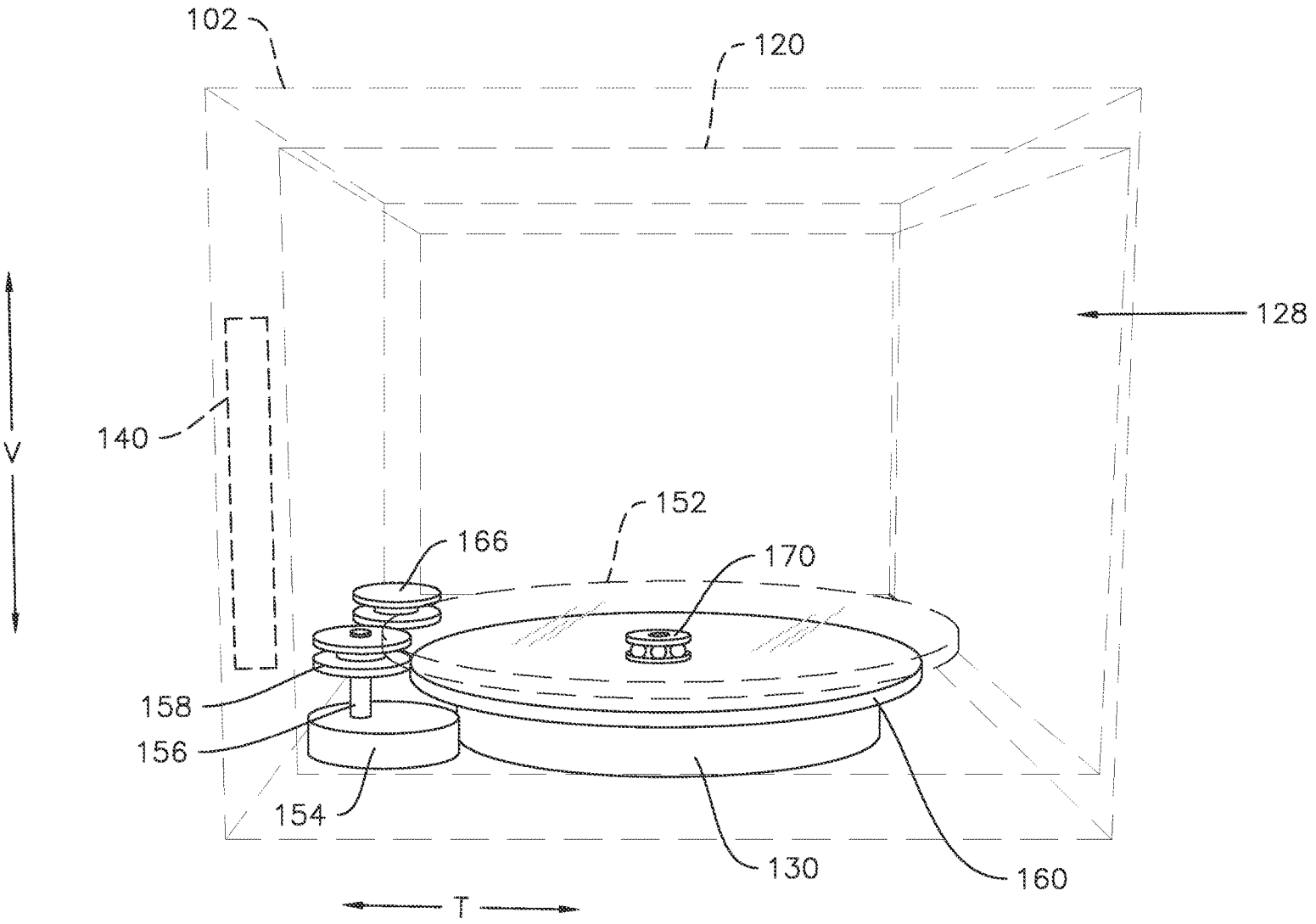
FIG. 5 provides a schematic perspective view of the cooking appliance of FIG. 1 with a cabinet, inner shell, and turntable thereof hidden.

In exemplary embodiments, cabinet 102 of cooking appliance 100 includes an inner shell 120 (see, e.g., FIGS. 3 through 5). Inner shell 120 of cabinet 102 delineates the interior volume of cooking chamber 128. Optionally, the walls of shell 120 may be constructed using high reflectivity (e.g., 72% reflectivity) stainless steel.

Cooking appliance 100 may include multiple cooking modules. In some embodiments, cooking appliance 100 includes a microwave module 140 (FIG. 5) and an induction heating module 130 mounted within cabinet 102. In additional or alternative embodiments, cooking appliance 100 may also include one or more additional cooking modules, such as an upper heater module or a convection module.

As is generally understood by those of ordinary skill in the art, the microwave module 140 includes a magnetron mounted within the cabinet 102 (e.g., above or behind cooking chamber 128) and in communication (e.g., fluid or transmissive communication) with the cooking chamber 128 to direct microwave radiation or microwaves thereto. In other words, the microwave module delivers microwave radiation into cooking chamber 128, as is understood by those of ordinary skill in the art. Since the structure and function of magnetrons are understood by those of ordinary skill in the art, the microwave module 140 is only illustrated schematically and is not described in further detail herein for the sake of brevity and clarity.

A lower heater module 130 may be mounted within cabinet 102, e.g., below cooking chamber 128. For instance, lower heater module 130 may be an induction heating module, as mentioned, e.g., may include an induction heating coil 136 (FIG. 2) mounted below cooking chamber 128, such as below a bottom wall 126 of the inner shell 120. As will be described in greater detail below, induction heating coil 136 may be in communication (e.g., transmissive communication) with cooking chamber 128 (e.g., through a one-way field filter 160) to direction a magnetic field 162 thereto.

As shown in FIG. 1, cooking appliance 100 includes controller 104. Controller 104 of cooking appliance 100 can include one or more processor(s) and one or more memory device(s). The processor(s) of controller 104 can be any suitable processing device, such as a microprocessor, microcontroller, integrated circuit, or other suitable processing device. The memory device(s) of controller 104 can include any suitable computing system or media, including, but not limited to, non-transitory computer-readable media, RAM, ROM, hard drives, flash drives, or other memory devices. The memory device(s) of controller 104 can store information accessible by the processor(s) of controller 104 including instructions that can be executed by the processor(s) of controller 104 in order to execute various cooking operations or cycles, e.g., a meal cook cycle. For example, the instructions can be software or any set of instructions that when executed by the processor(s), cause the processor(s) to perform operations. In some exemplary embodiments, the instructions may include a software package configured to operate the system, e.g., to execute exemplary methods as may be described herein. Controller 104 is communicatively coupled with various operational components of cooking appliance 100, such as components of microwave module 140, induction heating module 130, and control panel 118, including display device 120, dial 122, the various control buttons 124, etc. Input/output ("I/O") signals may be routed between controller 104 and control panel 118 as well as other operational components of cooking appliance 100. Controller 104 can execute and control cooking appliance 100 in various cooking operations or cycles, such as precision cooking and other modes.

Figure 2:
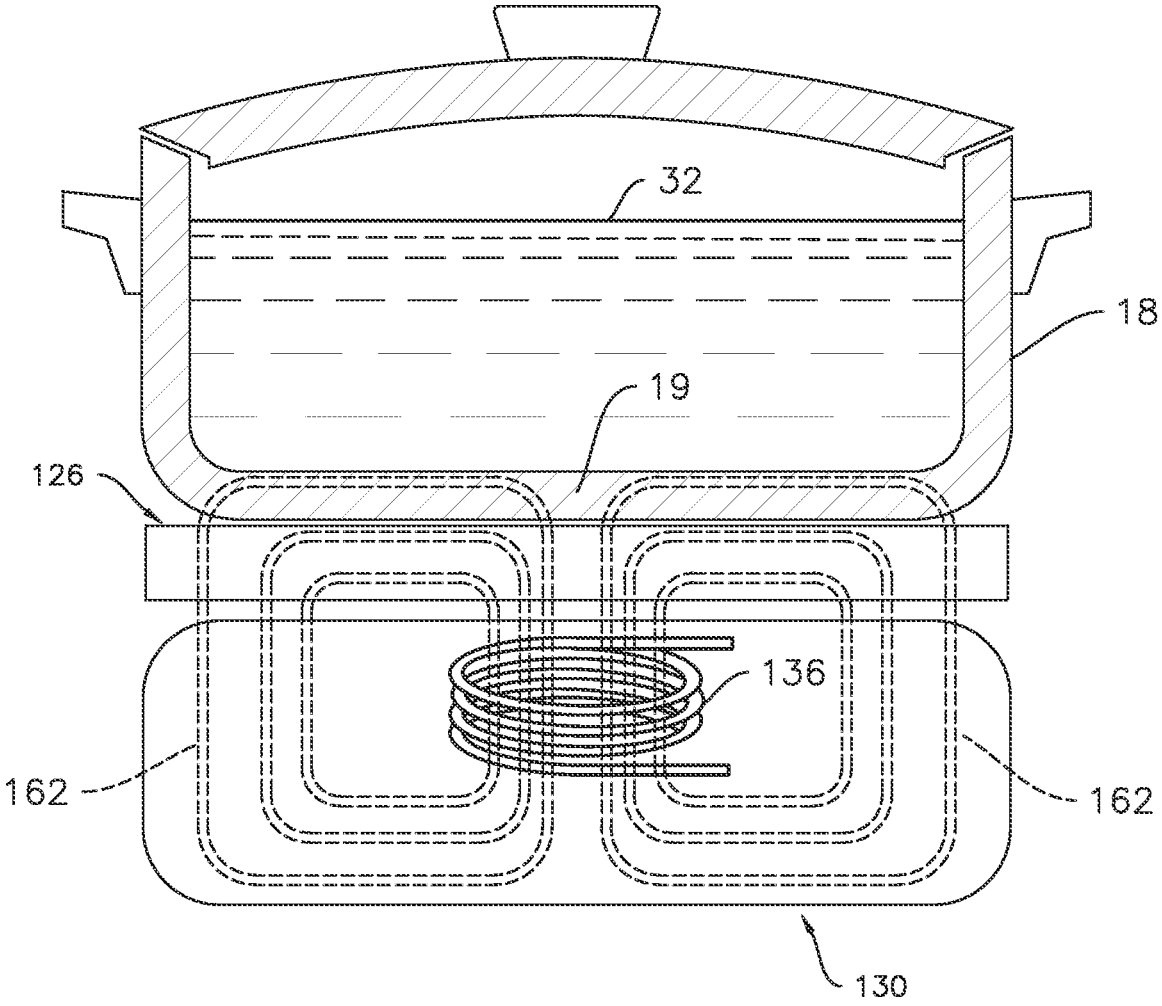
FIG. 2 provides a schematic view of an induction heating element of the cooking appliance heating a cooking utensil on the induction heating element.

FIG. 2 provides a schematic view of induction heating module 130 shown heating a cooking utensil 18 supported on the bottom wall 126 of the inner shell 120. Induction heating element 130 includes a Lenz coil or wire 136. As will be understood by those skilled in the art, cooking appliance 100 can supply a current to Lenz coil 136. As such, current passes through Lenz coil 136 and Lenz coil 136 generates a magnetic field (shown with dashed lines 162). The magnetic field 162 can be a high frequency circulating magnetic field. As shown in FIG. 2, Lenz coil 136 can be oriented such that magnetic field 162 is directed towards and through bottom wall 126 to cooking utensil 18. In particular, when magnetic field 162 penetrates cooking utensil 18, magnetic field 162 induces a circulating electrical current within cooking utensil 18, e.g., within a bottom wall 19 of cooking utensil 18. The material properties of cooking utensil 18 restrict a flow of the induced electrical current and convert the induced electrical current into heat within cooking utensil 18. As cooking utensil 18 heats up, contents 32 of cooking utensil 18 contained therein heat up as well. In such a manner, induction heating element 130 can cook contents 32 of cooking utensil 18.

In some embodiments, a turntable system 150 is further provided within cabinet 102. Generally, the turntable system 150 may include a rotatable platter or turntable 152 driven by a drive wheel 158 that is connected thereto (e.g., as explained in more detail below, the drive wheel 158 may itself be motivated by a motor 154). Thus, turntable 152 may be coupled to motor 154. Turntable motor 154 may be communicatively coupled to controller 104 and may be any suitable motor 154 for providing rotational motivating force to the turntable 152. In some exemplary embodiments, the motor 154 may be a stepper motor. The structure and function of motors are generally understood by those of skill in the art and, as such, are not shown or described in further detail herein for the sake of brevity and clarity. As indicated, e.g., in FIG. 6, the turntable system 150 includes the turntable 152 and the components which move or guide the turntable 152, such as the motor 154, drive wheel 158, guide wheel 166, and hub 170.

Turning now to FIGS. 3 through 6, the turntable 152 may be rotatably mounted within the cooking chamber 128, such as at a geometric center 168 of the turntable 152, e.g., whereby the turntable 152 rotates around the center 168 of the turntable 152. For example, the turntable 152 may be rotatably mounted on a rotation hub 170 and the rotation hub 170 may be positioned on the bottom wall 126 of the inner shell 120. In some embodiments, the rotation hub 170 may include a plurality of ball bearings 172 to promote rotation of the turntable 152 within and relative to the cooking chamber 128, e.g., relative to the bottom wall 126.

As mentioned above, the motor 154 may be operatively coupled to the turntable 152. As illustrated, e.g., in FIGS. 5 and 6, the motor 154 may be mounted within the cabinet 102 outside of the cooking chamber 128, such as between the inner shell 120 and the cabinet 102. The motor 154 may thereby be disposed adjacent to the induction heating coil 130. As may be seen in FIGS. 3 through 6 more generally, the motor 154 may be offset from a geometric center of the cooking chamber 128 and/or offset from the center 168 of the turntable 152. In at least some embodiments, the turntable 152 may be centered within the cooking chamber 128, e.g., such that the center 168 of the turntable 152 generally coincides with the center of the cooking chamber 128, such as the center 168 may be aligned with the center of the cooking chamber 128, directly below the center of the cooking chamber 128 along the vertical direction V. As a result of such offset, the motor 154 may thereby be positioned outside of the magnetic field 162 from the induction heating coil 136. Accordingly, the metal parts of the motor 154 may not be affected by or interact with the magnetic field 162, and/or such interaction may be minimized because of the offset location of the motor 154.

Figure 6:
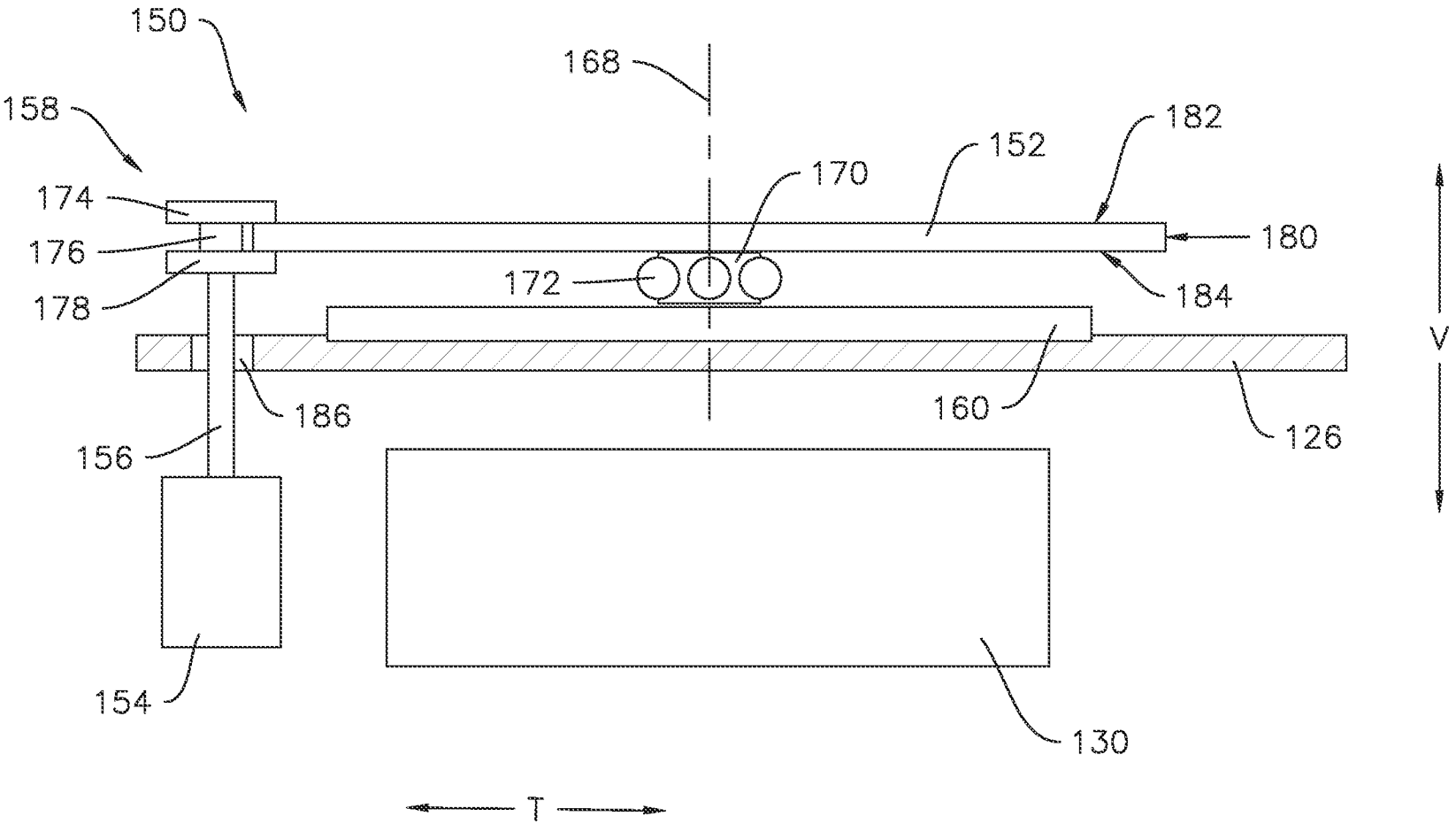
FIG. 6 provides a schematic partial section view of a portion of the cooking appliance of FIG. 1.

As illustrated in FIGS. 5 and 6, in some embodiments, the motor 154 may be directly coupled to a drive shaft 156. Thus, the motor 154 may rotate the drive shaft 156 when the motor 154 is activated, e.g., by the controller 104, and the motor 154 may be coupled to the turntable 152 via the drive shaft 156. Additionally, a drive wheel 158 may be mounted on the drive shaft 156. As may be seen, e.g., in FIG. 6, the drive wheel 158 may be in direct contact with the turntable 152 such that rotation of the drive shaft 156 by the motor 154 is transferred to the turntable 152 via the drive wheel 158. The motor 154 of the turntable system 150 may be positioned outside of the cooking chamber 128, e.g., below the bottom wall 126 of the cooking chamber 128. In such embodiments, the drive shaft 156 may extend through the bottom wall 126, such as through an aperture 186 (FIG. 6) defined in and extending through the bottom wall 126.

As may be seen, e.g., in FIGS. 3 through 5, the cooking appliance 100 may also include a guide wheel 166, which may also (like the drive wheel 158) be abutting the turntable 152. Whereas the drive wheel 158 is directly driven by the drive shaft 156 and motor 154, the guide wheel 166 may be provided to stabilize and maintain alignment of the turntable 152 while the guide wheel 166 does not impart or transfer a motive force to the turntable 152. As illustrated, e.g., in FIG. 4, the drive wheel 158 and the guide wheel 166 may be structurally similar (apart from the direct connection of the drive wheel 158 to the drive shaft 156), e.g., the drive wheel 158 and guide wheel 166 may have generally the same size and/or shape. The drive wheel 158 and the guide wheel 166 may be aligned, such as along the lateral direction L. For example, the center, frontmost point, and/or rearmost point of the drive wheel 158 may be colinear with the or each corresponding part, e.g., center, etc., of the guide wheel 166 on a line which extends along or parallel to the lateral direction L. In some embodiments, the drive wheel 158 and the guide wheel 166 may both be mounted on a bar 164. For example, in some embodiments, the bar 164 may extend generally along the lateral direction L behind the induction heating module 130. In some embodiments, the drive wheel 158 may be mounted on the bar 164 with the guide wheel 166 mounted on the bar 164 and spaced apart from the drive wheel 158, e.g., along the lateral direction L as mentioned.

As mentioned above, the drive wheel 158 may be in contact with the turntable 152. For example, as illustrated in FIG. 6, the turntable 152 may include an upper surface 182, e.g., a circular surface oriented upwards along the vertical direction V, an outer edge 180, and a lower surface 184 opposite the upper surface 182. For example, the lower surface 184 may be a circular surface oriented downwards along the vertical direction V, and the outer edge 180 may be a generally cylindrical surface extending between the upper surface 182 and the lower surface 184. Still with reference to FIG. 6, the drive wheel 158 may include a central hub 176, an upper flange 174, and a lower flange 178. The central hub 176 of the drive wheel 158 may be aligned with the outer edge 180 of the turntable 152, such as along the vertical direction V, e.g., positioned at generally the same distance above the bottom wall 126 along the vertical direction V. In some embodiments, the drive wheel 158 may be in contact with the turntable 152 at the upper flange 174 and the lower flange 178 of the drive wheel 158. In particular, the upper flange 174 may be positioned above the turntable 152 and in contact with the upper surface 182 of the turntable 152, and the lower flange 178 may be positioned below the turntable 152 and in contact with the bottom surface 184 of the turntable 152. Through such contact, the drive wheel 158 may transfer rotation from the drive shaft 156 to the turntable 152. As mentioned, the guide wheel 166 may have generally the same size and shape as the drive wheel 158. Thus, although not specifically illustrated, it should be understood that the guide wheel 166 may also include an upper flange and lower flange at opposite vertical ends of a central hub, and the upper and lower flanges of the guide wheel 166 may also be in contact with the upper and lower surface 182 and 184, respectively, of the turntable 152, e.g., as is generally depicted in FIGS. 3 and 5.

In certain embodiments, a one-way field filter 160 is provided between induction heating coil 136 and cooking chamber 128. For example, turntable 152 may be positioned above a one-way field filter 160 within cooking chamber 128. One-way field filter 160 may limit or restrict passage of microwave radiation or microwaves 132 while significantly and advantageously permitting the magnetic field 162. The magnetic field 162 generated by induction heating coil 136 may thus be forced to pass through one-way field filter 160 before entering cooking chamber 128.

Figure 7:
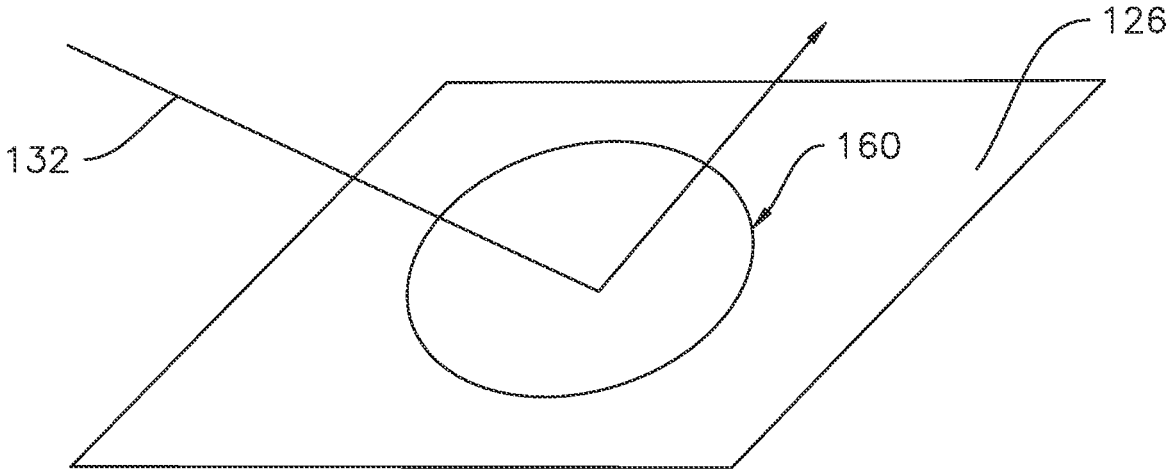
FIG. 7 provides a schematic, perspective view of a one-way field filter of a cooking appliance receiving microwaves according to exemplary embodiments of the present disclosure.
Figure 8:
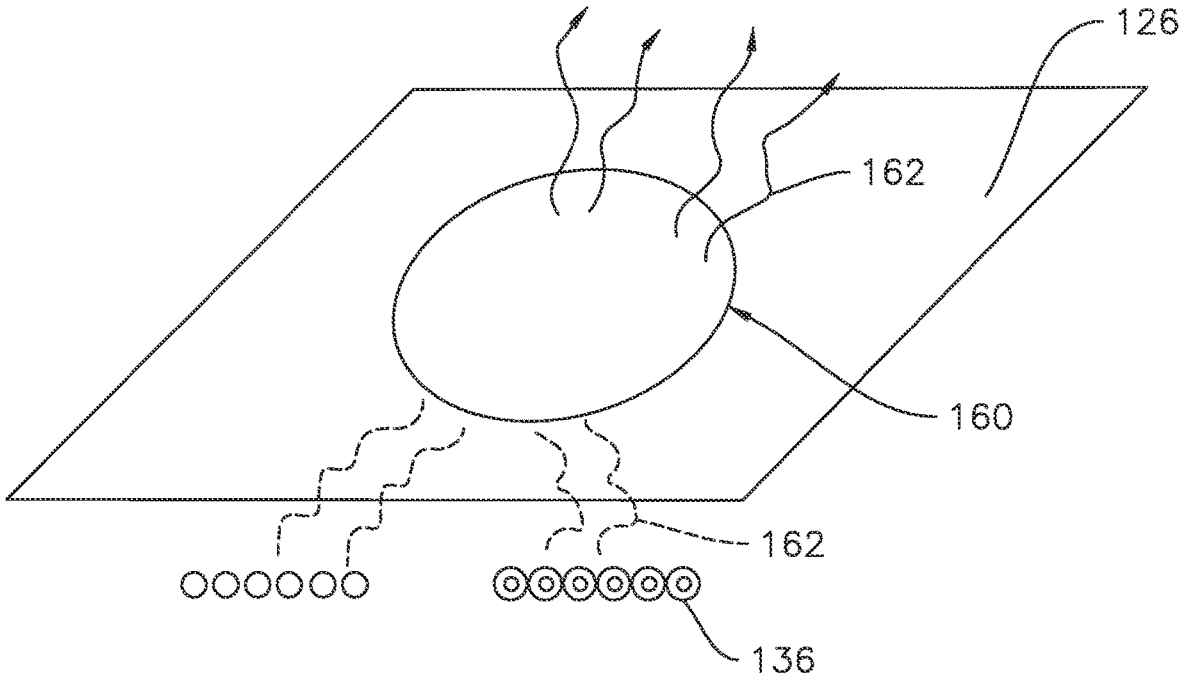
FIG. 8 provides a schematic, perspective view of a one-way field filter of a cooking appliance receiving a magnetic field according to exemplary embodiments of the present disclosure.

Turning now to FIGS. 7 and 8, various views are provided of one-way field filter 160. Advantageously, the one-way field filter 160 may permit magnetic field 162 to pass (e.g., upward) therethrough to cooking chamber 128 while simultaneously preventing passage of microwaves 132 (e.g., downward) therethrough from cooking chamber 128 to induction heating coil 136.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

a cabinet defining a cooking chamber;

a magnetron mounted within the cabinet in communication with the cooking chamber to direct a microwave thereto;

an induction heating coil mounted within the cabinet in communication with the cooking chamber to direct a magnetic field thereto;

a turntable rotatably mounted in the cooking chamber;

a motor operatively coupled to the turntable mounted within the cabinet outside of the cooking chamber and adjacent to the induction heating coil, the motor offset from a geometric center of the cooking chamber whereby the motor is positioned outside of the magnetic field from the induction heating coil, wherein the motor is directly coupled to a drive shaft whereby the motor rotates the drive shaft when the motor is activated, and the motor is coupled to the turntable via the drive shaft; and a drive wheel mounted on the drive shaft, wherein the drive wheel is in direct contact with the turntable, whereby rotation of the drive shaft is transferred to the turntable via the drive wheel, wherein the drive wheel comprises an upper flange positioned above the turntable and a lower flange positioned below the turntable.

2. The cooking appliance of claim 1, wherein the drive wheel comprises a central hub aligned with an outer edge of the turntable.

3. The cooking appliance of claim 1, further comprising a guide wheel abutting the turntable.

4. The cooking appliance of claim 3, further comprising a drive wheel coupled to the motor whereby rotation of the motor is transferred to the turntable via the drive wheel.

5. The cooking appliance of claim 4, wherein the drive wheel is mounted on a bar and the guide wheel is mounted on the bar spaced apart from the drive wheel.

6. The cooking appliance of claim 1, wherein the turntable is mounted on a bottom wall of the cooking chamber via a rotation hub.

7. A cooking appliance comprising:

a cabinet defining a cooking chamber;

a magnetron mounted within the cabinet in communication with the cooking chamber to direct a microwave thereto;

an induction heating coil mounted within the cabinet in communication with the cooking chamber to direct a magnetic field thereto;

a turntable rotatably mounted in the cooking chamber at a center of the turntable;

a motor operatively coupled to the turntable mounted within the cabinet outside of the cooking chamber and adjacent to the induction heating coil, the motor offset from the center of the turntable whereby the motor is positioned outside of the magnetic field from the induction heating coil, wherein the motor is directly coupled to a drive shaft whereby the motor rotates the drive shaft when the motor is activated, and the motor is coupled to the turntable via the drive shaft; and a drive wheel mounted on the drive shaft, wherein the drive wheel is in direct contact with the turntable, whereby rotation of the drive shaft is transferred to the turntable via the drive wheel, wherein the drive wheel comprises an upper flange positioned above the turntable and a lower flange positioned below the turntable.

8. The cooking appliance of claim 7, wherein the drive wheel comprises a central hub aligned with an outer edge of the turntable.

9. The cooking appliance of claim 7, further comprising a guide wheel abutting the turntable.

10. The cooking appliance of claim 9, further comprising a drive wheel coupled to the motor whereby rotation of the motor is transferred to the turntable via the drive wheel.

11. The cooking appliance of claim 10, wherein the drive wheel is mounted on a bar and the guide wheel is mounted on the bar spaced apart from the drive wheel.

12. The cooking appliance of claim 7, wherein the turntable is mounted on a bottom wall of the cooking chamber via a rotation hub.

* * * * *